United States Patent [19]

Collins

[11] 4,137,574

[45] Feb. 6, 1979

[54] PORTABLE STEAM BATH

[76] Inventor: Jack Collins, R.R. #1 Box 288, Mt. Juliet, Tenn. 37122

[21] Appl. No.: 822,991

[22] Filed: Aug. 9, 1977

[51] Int. Cl.[2] ..... A61H 33/06

[52] U.S. Cl. ..... 4/160; 4/145; 4/154; 4/155; 4/156; 128/367

[58] Field of Search ..... 4/145, 146, 154, 160, 4/161, 162, 155, 164, 156; 128/366, 367

[56] References Cited

U.S. PATENT DOCUMENTS

| | | | |
|---|---|---|---|
| 1,932,788 | 10/1933 | Keating | 4/160 |
| 2,858,547 | 11/1958 | Baumann | 4/160 |
| 3,007,178 | 11/1961 | Altman et al. | 4/162 X |
| 3,351,956 | 11/1967 | Thoner | 4/160 |
| 3,419,915 | 1/1969 | Clark, Jr. | 4/160 |
| 3,624,844 | 12/1971 | Sharps | 4/160 |
| 3,629,875 | 12/1971 | Dow et al. | 4/146 |
| 3,925,828 | 12/1975 | Kim | 4/147 |

*Primary Examiner*—Henry K. Artis

[57] ABSTRACT

A portable steam bath having a rigid, bracket-supported top including a heat lamp, and a curtain depending therefrom to a rigid tub of the same size and general configuration as the top, the tub being connectible with a steam generator, water supply and safety electric units, all of which, together with the curtain, may be placed in the top and tub, which combination unit may then be connected and carried as a suitcase.

5 Claims, 8 Drawing Figures

PORTABLE STEAM BATH

This invention relates generally to steam bath units and more particularly to a complete one-man portable unit which may be as readily carried as a suitcase.

Various types of steam bath units are known in the art but insofar as is known, these are characterized by one or more disadvantageous features. Among these are: an unnecessary elaborateness resulting in excessive cost; a lack of portability so as to limit usage thereof; and when portable or collapsible, the need for the human body to support it in operative position, thus limiting the movement of the person using the bath.

Accordingly, the main object of the present invention is to provide a portable steam bath which will obviate the above and other disadvantageous features characterizing known structures.

An important object of the present invention is to provide an improved portable steam bath unit which may be detachably supported in operative position from a wall or door of a building or other support.

Another important object of the present invention is to provide an improved portable steam bath unit which may be readily converted as a whole from the operative position to a portable condition so as to be easily carried like a suitcase.

A further important object of the present invention is to provide a portable one-man steam bath unit having a timer and a thermal safety switch to prevent overheating of the steam generator.

A still further important object of the present invention is to provide a gravity fed reservoir which will maintain a constant level of water in the steam generator.

Other objects and advantages of the invention will become apparent during the course of the following description.

In the drawings, I have shown one embodiment of the invention. In this showing:

Figure 1:
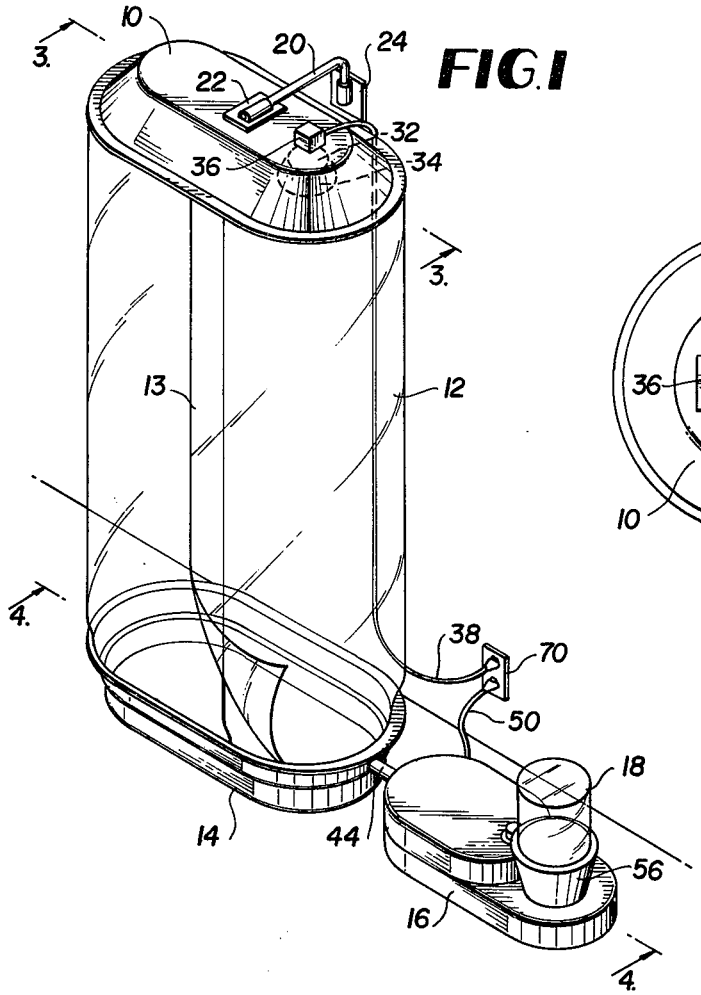
FIG. 1 is a perspective view of the present invention in operative position supported by a wall bracket.

Referring to the drawings, the steam bath unit comprises essentially a top 10, a shower curtain 12, a tub 14, a steam generator 16, and a water reservoir 18, and the top 10 and bottom or tub 14 are vacuum formed from a plastic known as ABS which is rigid, strong and durable.

Figure 8:
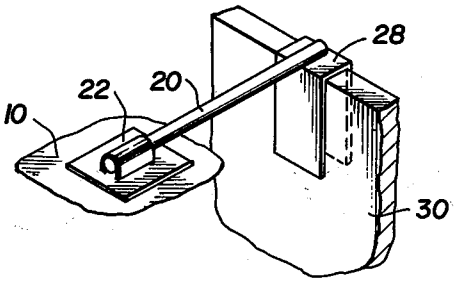
FIG. 8 is a modified form of wall bracket wherein the unit is supported by a U-shaped bracket positioned over a door, etc.

In its operative position as disclosed in FIG. 1, the oval, dish shaped top 10 is supported by an L-shaped arm 20 fixed to a top bracket 22 and to a wall bracket 24. If desired, a U-shaped bracket 28 (FIG. 8) to fit over the top of a door 30 may be substituted for the wall bracket 24.

A heat lamp 32 having a fibreglass guard 34 is mounted in an electric box 36 at one end of the top 10 and is connectible to any 120 V. wall plug by an electric cord 38.

Figure 3:
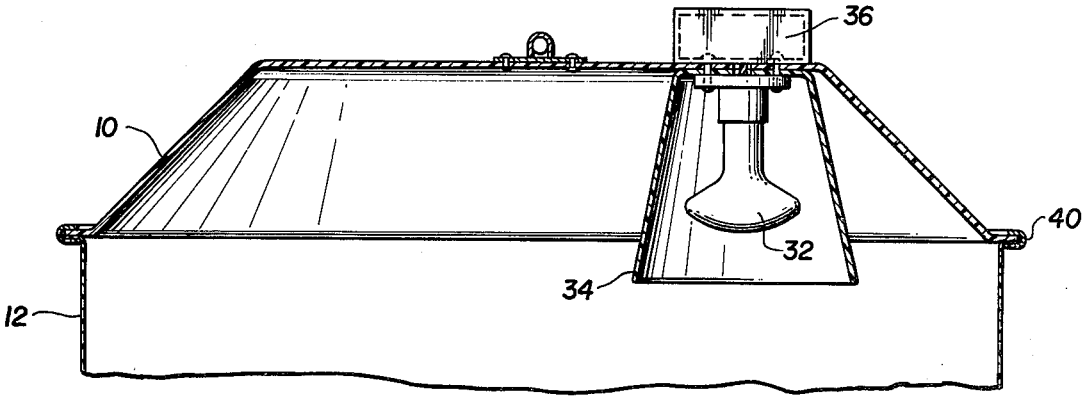
FIG. 3 is a vertical, longitudinal sectional view of the rigid top of the unit and the heat lamp with its guard mounted therein, taken on the line 3—3 of FIG. 1.
Figure 7:
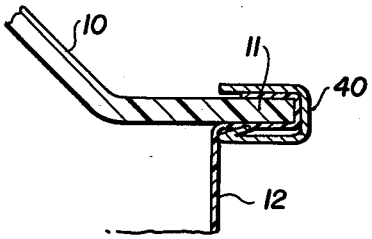
FIG. 7 is a fragmentary, vertical sectional view of one end of the rigid top showing how the shower curtain is clipped thereto.

The curtain 12 which may be a clear or frosty vinyl is resiliently clamped to the peripheral edge 11 of the top 10 by means of self-locking end-to-end abutting, vinyl covered, metal extrusions 40 (FIGS. 3 and 7). If desired, these may also be employed on the peripherally flanged edge 15 of the tub 14 or the curtain bottom edge may merely rest within the tub. Thus the curtain can be adjusted to any person regardless of height and the steam bath is very easy to enter or exit from as there is a 12 inch overlap 13 of the curtain 12 on each side.

Figure 4:
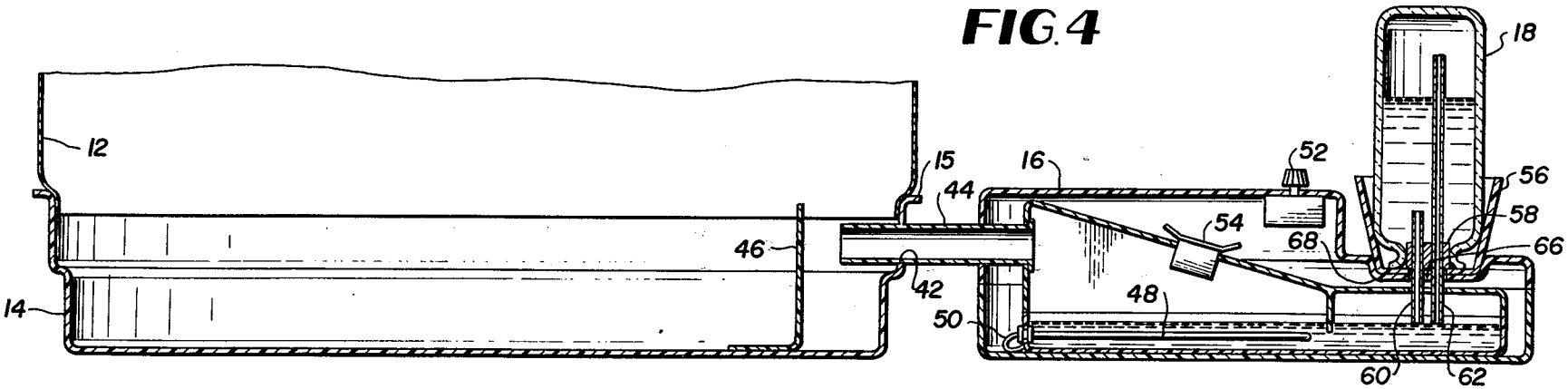
FIG. 4 is a similar view of the tub or bottom of the steam bath unit with the steam generator connected therewith and the water reservoir in position, taken on the line 4—4 of FIG. 1.

The tub or bottom 14 is the same shape as the top 10 and is 6 inches deep. As seen in FIGS. 1 and 4, one end of the tub is provided with an aperture 42 for the reception of a plastic steam discharge pipe 44 extending from the steam generator 16. To prevent the entering steam from discharging directly onto the feet of a user, an L-shaped baffle 46 is fixed to the floor of the tub directly in front of the end of the pipe 44.

The generator 16 is formed of thermal resin fiberglass to withstand temperatures up to 500 degrees, F. and is provided with a 1200 watt heating unit 48 which is connectible to any 120 V. wall outlet by an electric cord 50. Incorporated in the heating unit circuit is a timer 52 and a safety thermal heat switch 54 which opens the circuit at 220 degrees, F. This prevents damage and burns in the event that the user neglects to fill the water supply.

The water reservoir 18 is provided with an apertured supporting bracket 56 formed of ABS plastic and a plug 58 through which two tubes 60, 62 project within the generator 16 to automatically maintain a constant level of water therein. As shown in FIG. 4, water enters the generator through the short tube 60, the flow being permitted by entrance of replacement air into the reservoir 18 by the long tube 62 until the ends of the tubes are covered by the water level.

In operation, the top having been mounted at a suitable height for the user, the depending curtain indicates the proper spot for the tub 14 which is so positioned. The steam discharge pipe 44 of the steam generator 16 is now inserted into the aperture 42 of the tub 14 and the reservoir 18 is filled, the plug 58 inserted, and inverted into its supporting bracket 56 which is a tapered cup having a central aperture 66 in its bottom in alignment with a similar aperture in the circular recess 68 formed in the top of the right end (FIG. 4) of the generator 16.

Both electric cords 38 and 50 are plugged into a wall outlet 70 and the timer 52 is turned on and set for 15 minutes to start the generation of the steam and fill the curtain 12. The timer is then reset for the desired number of minutes and the user may step into the unit. It will be appreciated that the heat lamp 32 will delay the condensing of the steam within the curtain thereby using less water.

Figure 5:
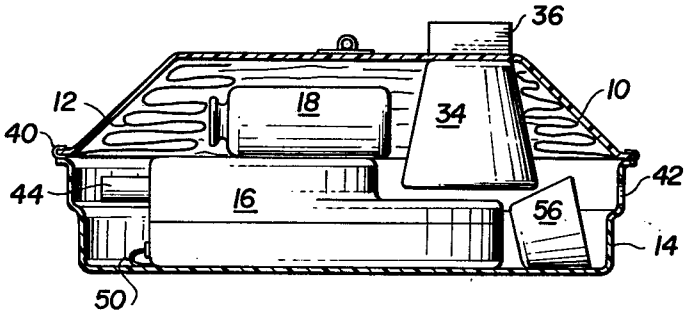
FIG. 5 is a vertical broken away view of the top, tub and parts assembled for the portable position.

When it is desired to move the steam bath unit to another place, the tub 14, generator 16 and reservoir 18 are, of course, drained of water. As shown in FIG. 5, the generator 16 whose right end is reduced in height to accommodate the heat lamp guard 34 in the portable position, is placed in the tub 14 together with the reservoir 18 and its supporting bracket 56. The curtain 12 is now stuffed into the top 10 and it is placed on the tub 14.

The top 10 and bottom 14 are held together by conforming and generally U-shaped wire clamps 70 and 72 respectively extending along their joined edges as shown. The upper clamp 70 has a centrally extending rod 74 including an angled portion forming a handle 76. The lower clamp 72 has a centrally extending rod 78 over which each of a pair of straps 80 pass to hold the two clamps and the top 10 and bottom 14 tightly together. The straps 80 extend from the rear rod of the upper clamp 70 down around the tub 14, over the central rod 78 and under the outer connecting rods upwardly along the top 10 where they terminate in snaps 82 which engage the lower rod of the upper wire clamp 70 (FIGS. 2 and 6).

Figure 2:
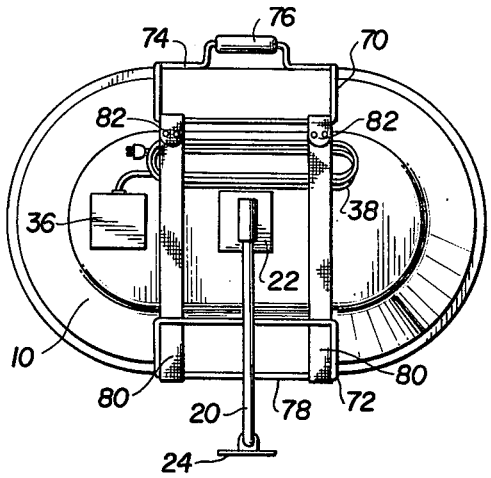
FIG. 2 is a side elevational view showing the steam bath unit in portable condition for carrying like a suitcase.
Figure 6:
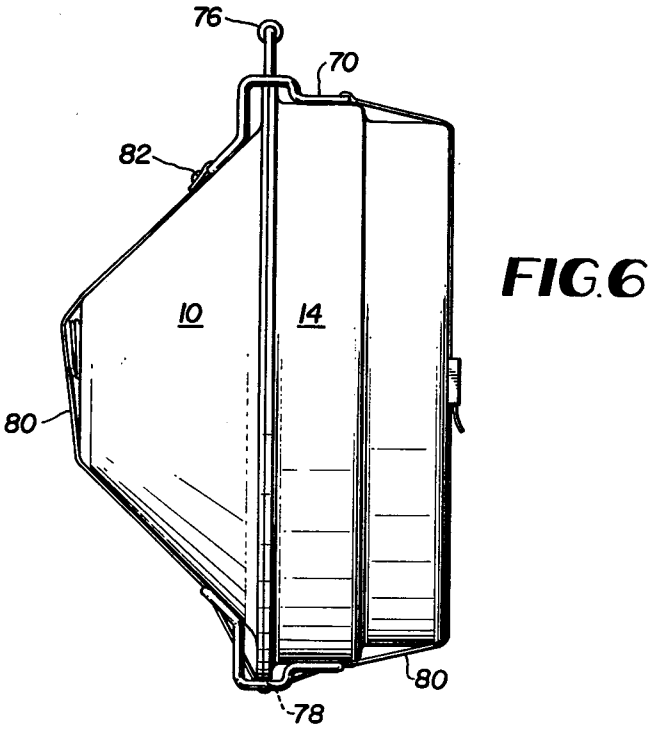
FIG. 6 is an end elevational view of the unit in the portable position.

In one form of the invention as shown, the portable steam bath unit only weighs a total of 18 pounds and as shown in FIGS. 2 and 6, the unit is thirty three inches long, 21 inches wide and 10.5 inches thick. Thus the unit is as readily portable as a suitcase, is efficient in operation, and is of low cost and free of maintenance.

It is to be understood that the form of my invention herewith shown and described is to be taken as a preferred example of the same and that various changes in the shape, size and arrengement of parts may be resorted to without departure from the spirit of the invention or the scope of the subjoined claims.

What is claimed is:

1. A portable, completely self contained, steam bath unit comprising two mating, rigid and generally oval dish shaped portions adapted to be clamped together and carried by a handle; one of said portions having a bracket for supporting it in inverted position from a support spaced well above the floor; said inverted portion having a heat lamp mounted therein to delay the condensing of generated steam; the other of said portions being positioned on the floor in an upright position directly below said inverted portion; a curtain depending from said inverted portion and terminating within said upright portion; a steam generator detachably connected with said upright portion; and a water reservoir detachably connected to said generator; said curtain, generator and reservoir all being contained within said rigid portions when clamped together in carrying position.

2. The combination recited in claim 1 wherein said reservoir automatically maintains a predetermined level of the water in said generator.

3. The combination recited in claim 1 wherein the curtain is formed of two overlapping sections to enable easy ingress to and egress from said steam bath unit.

4. The combination recited in claim 1; and timing means mounted on said generator for regulating the duration of steam generation.

5. The combination recited in claim 1; and safety switch means controlling said generator to prevent overheating thereof.

* * * * *